United States Patent [19]

Jenkins et al.

[11] Patent Number: 4,560,304

[45] Date of Patent: Dec. 24, 1985

[54] METHOD AND APPARATUS FOR IMPEDING SEDIMENT DEPOSITION IN HARBORS AND NAVIGATION CHANNELS

[75] Inventors: Scott A. Jenkins, San Diego; Joseph B. Sparks, Vacaville, both of Calif.

[73] Assignee: The Regents of the University of California, Berkeley, Calif.

[21] Appl. No.: 513,865

[22] Filed: Jul. 14, 1983

[51] Int. Cl.[4] ..... E02B 8/02

[52] U.S. Cl. ..... 405/74; 405/15; 405/52

[58] Field of Search ..... 405/74, 15, 23, 26, 405/52, 60

[56] References Cited

U.S. PATENT DOCUMENTS

| | | | |
|---|---|---|---|
| 1,042,792 | 10/1912 | Henderson | 405/74 X |
| 1,858,231 | 5/1932 | Parshall | 405/74 |
| 3,691,774 | 9/1972 | Hard | 405/26 |
| 3,971,221 | 7/1976 | Greenleaf | 405/26 |
| 4,036,022 | 7/1977 | Larsen | 405/74 |
| 4,264,233 | 4/1981 | McCambridge | 405/26 |

FOREIGN PATENT DOCUMENTS

| | | | |
|---|---|---|---|
| 835873 | 4/1952 | Fed. Rep. of Germany | 405/26 |
| 23118 | of 1894 | United Kingdom | 405/74 |

*Primary Examiner*—Dennis L. Taylor

*Attorney, Agent, or Firm*—Brown, Martin & Haller

[57] ABSTRACT

A buoyant high aspect ratio delta wing having an inverted airfoil shape for producing a downward lift force is anchored at a negative angle of attack adjacent the bottom of a waterway having a current. The net vertical deflection and turbulent trailing wake generated as the water flows past the wing prevents sediments from depositing on the bottom of the waterway for a predetermined distance downstream of the wing. Cascading arrays of such wings may be anchored in succession along the waterway to resuspend sediments and thereby maintain sufficient water depth for navigation while avoiding the cost and environmental drawbacks of dredging.

38 Claims, 10 Drawing Figures

METHOD AND APPARATUS FOR IMPEDING SEDIMENT DEPOSITION IN HARBORS AND NAVIGATION CHANNELS

ACKNOWLEDGEMENT

This invention was made with Government support under Grant Nos. N00014-76-C-0440; N00014-76-C-0631; and N00014-82-K-0111, awarded by the Department of Defense. The Government has certain rights in this invention.

BACKGROUND OF THE INVENTION

The present invention relates to the maintenance of sufficient water depth in harbors and navigation channels, and more particularly, to a method and apparatus for eliminating the need for periodic dredging of such waterways by passively resuspending sediments transported to the waterways by natural currents.

Most of our present day harbors were sited several hundred years ago in the embayments and quiet waters around drowned river mouths. Although the natural water depth in these harbors was adequate for the 6-m-draft wooden sailing ships of that era, ships' drafts have since more than doubled. Indeed, a fully loaded supertanker, aircraft carrier, or nuclear submarine may draft almost as much as 14 m.

Few of the historic harbors provide or maintain that much deep water through natural circulation and scour; those that do, such as in San Francisco, Puget Sound, or San Diego, still have local shallows, shoals, and inlet bars requiring artificial deepening. Other historic harbors were once natural deepwater harbors, but are no longer. An example is Charleston, S.C., where upstream the Cooper River has been diverted for a hydroelectric plant, resulting in as much as 5 m of annual shoaling in Charleston Harbor. The sediments are, of course, the continual by-product of erosion and weathering; their transport pathway down the rivers to the sea is intercepted by the artificially deepened harbors.

With the advent of steam power and the first deep-draft iron-hulled ships, the first suction dredges also appeared, and it became easier to dig than to relocate the harbors. Deepening our harbors by overdredging has diminished the bottom velocities and stresses caused by natural circulation and has thereby retarded the transport of sediment bound for the sea. Thus the deeper a harbor is dredged, the more rapidly subsequent sedimentation acts to refill it.

Also, after 150 years of dredging, places to dump all the sediments are scarce. The problem is compounded by recent environmental constraints since it has been learned that these sediments tend to concentrate heavy-metal toxins, halogenatd hydrocarbons, pesticides, and huge amounts of anaerobic bacteria. The contaminants are released back into the water by the bottom agitation of dredging activity. These factors combine with rising energy costs to render continual maintenance dredging too expensive or too harzardous to the environment.

SUMMARY OF THE INVENTION

Accordingly, it is the primary object of the present invention to provide a method and apparatus for impeding sediment deposition in harbors and navigation channels.

Another object of the present invention is to provide a method and apparatus which eliminates the need to periodically dredge harbors and navigation channels.

Another object of the present invention is to provide a method and apparatus which will impede sediment deposition in harbors and navigation channels utilizing passive devices anchored in the water.

Another object of the present invention is to provide a method and apparatus which will impede salt wedge intrusion into waterways which empty into the sea.

Another object of the present invention is to provide a method and apparatus for preventing mud from clogging the intakes in the hulls of ships moored for extended periods of time in harbors and navigation channels.

Another object of the present invention is to reduce the cost of maintaining sufficient water depth in harbors and navigation channels.

Another object of the present invention is to reduce environmental hazards which result from toxic materials and bacteria released into the water by the bottom agitation of dredging activity.

In the illustrated embodiment of the present invention a buoyant high aspect ratio delta wing having an inverted airfoil shape for producing a downward lift force is anchored at a negative angle of attack adjacent the bottom of a waterway having a current. The net vertical deflection and turbulent trailing wake generated as the water flows past the wing prevents sediments from depositing on the bottom of the waterway for a predetermined distance downstream of the wing. Cascading arrays of such wings may be anchored in succession along the waterway to resuspend sediments and thereby maintain sufficient water depth for navigation while avoiding the cost and environmental drawbacks of dredging.

DESCRIPTION OF THE PREFERRED EMBODIMENTS

Figure 1:
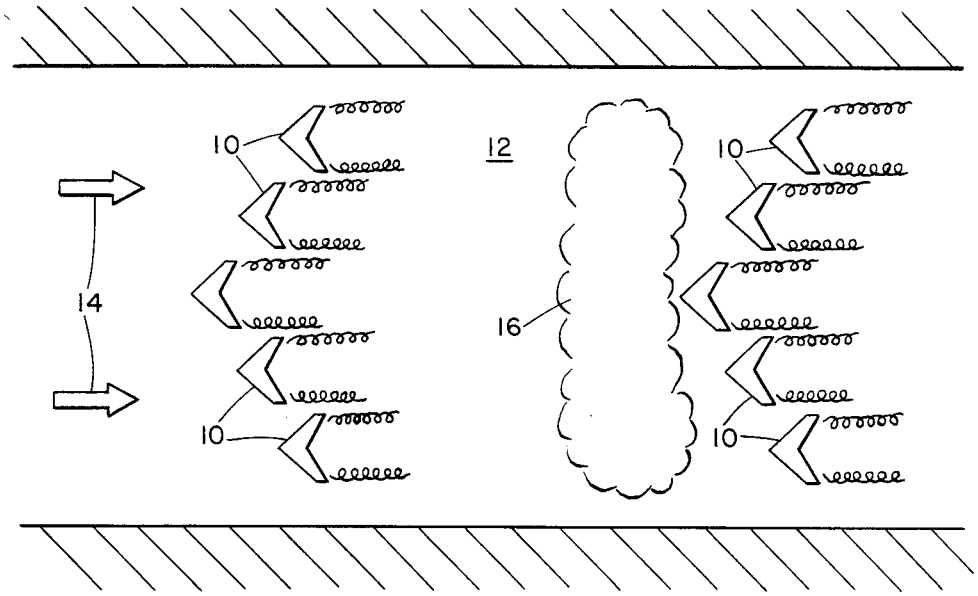
FIG. 1 is a schematic illustration of the manner in which the net vertical deflection and turbulent trailing wakes produced by a succession of cascading arrays of inverted delta wings moored adjacent the bottom of a shipping channel will prevent the deposition of sediment transported by the natural current.

Once sediments have flocculated in response to mixing with the salt wedge which intrudes into a body of water which empties into the sea, the sediments precipitate or drop out of the water and accumulate near the bottom. Here the sediments gradually settle and become cohesive mud if they remain immobile for more than about seventy-two hours. However, if disturbed by the action of further vortical mixing, the settle flocs can be prevented from becoming cohesive mud. This effect of vortical resuspension is evidenced dramatically by wake vortices shed from the support piles of a bridge spanning a large river. The vortices resuspend large amounts of sediment on the downstream side of the bridge. Increased bottom stress caused by wake turbulence from the bridge is responsible for local deepening of the river.

It is impractical to obstruct waterways such as harbors and navigation channels with vertical turbulenc-generating piles. Therefore, we have developd an alternative vortex-generating hydrodynamic body in the form of a delta shaped lifting wing turned upside down and placed near the bottom of the waterway. The wing is not only a very efficient vortex generator, but also imparts a net vertical deflection to the turbulent trailing wake, commonly known as downwash in aeronautical terminoloy. The turbulent upwash produced by our wing, when moored adjacent the bottom, is released behind the wing to resuspend sediment. Thus, our invention takes advantage of the principle of vortical and net vertical deflection to resuspend sediments by passive use of a moored wing in conjunction with river or tidal current. The term "passive" refers to a lack of energy input to the device other than natural currents. The waterway must have some current in order for our method and apparatus to achieve the objective of impeding sediment deposition. For every low currents, such as one-quarter of a knot, very large wings may be required.

According to our invention, tightly packed successive cascading arrays of inverted lifting wings 10 are moored adjacent the bottom of a navigation channel 12 having a downstream current indicated by arrows 14. The net vertical deflection and turbulent trailing wakes produced by the action of the water flowing past the wings 10 resuspends sediments 16 to prevent them from depositing on the bottom of the channel. The turbulence and net vertical deflection generated by the upstream array of wings acts only to resuspend the sediment for a limited distance. The downstream array of wings acts to resuspend the sediment after it has nearly settled to the bottom following the vortex and uplift action of the upstream array of wings. In this manner, successive arrays of such wings can impede sediment deposition and build up of mud along the bottom of a navigation channel all the way to the open ocean if desired.

Considering the flow dynamics across a lifting wing in greater detail, the vortex which trails behind an airplane wing causes "downwash" in aeronautical terminology. The fluid circulation which the lifting wing creates with its shape and angle of attack is shed into the wake as a system of trailing vortex filaments. As the circulation varies across the wing span, vortex filaments are released with opposite rotation behind each half span. In this manner, each symmetric trailing vortex pair forms a horseshoe vortex element in conjunction with the bound vorticity in the boundary layer of the wing. In the case of an airplane wing, the vector sum of the induced velocity from the entire wing vortex produces a net downward acceleration of fluid across the span of the wing which is the fluid reaction to the upward lift force. Beyond the wing tips there is a residual upwash from the last trailing vortex pair which decays quickly away from the wing.

Figure 8:
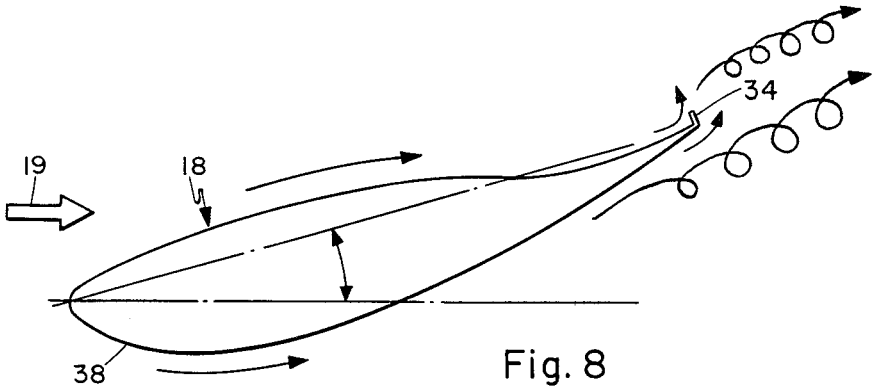
FIG. 8 illustrates yet another alternate airfoil shape for the wing of the present invention.

Referring to FIG. 8, according to our invention a lifting wing 18 is placed upside down and near the bottom of a body of water with its leading edge pointed into the direction of the current illustrated by the arrow 20. The "downwash" in aeronautical terminology is directed upward away from the bottom as illustrated by the arrows adjacent the trailing edge of the wing in FIG. 8.

A net mean vertical motion can be superimposed on near bottom tidal currents by a plurality of inverted lifting wings or vortex foils as illustrated in FIG. 1. These wings raise the settled flocs back into suspension while tidal motion advects these sediments away. By arranging the individual wings in V-shaped arrays like a flock of geese, many small wings can be made to act like one large wing to cover the full width of the navigation channel. As the strength of the vortex field trailing behind the array of near bottom wings decays, and the flocs begin to re settle, a downstream array of these inverted wings resuspends the material again.

The hydrodynamic drag of all of the wings, which is made large by the work done in producing downward "lift" on each wing, will increase the effective bottom stress acting on the salt wedge. Thus, a cascading array of vortex wings impedes the intrusion of the salt wedge. By retarding the salt influx, shoaling over an entire estuary can be significantly diminished.

Figure 2:
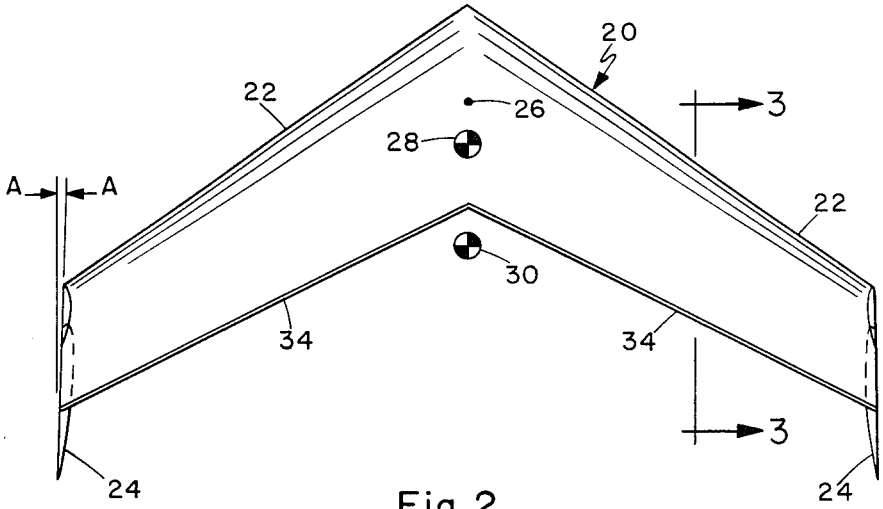
FIG. 2 is a top plan view of a lifting wing which may be submerged and anchored in an inverted position adjacent the bottom of a harbor or navigation channel to impede sediment deposition.

We have discovered that the configuration and orientation of the wing must be carefully selected in order to optimize the amount of net vertical deflection and the turbulent trailing wake. Referring to FIG. 2, one embodiment 20 of our wing is illustrated which is specially configured for use in preventing sediment deposition. The wing preferably has an aspect ratio from 8:1 to 10:1 and has a swept back geometry defining a pair of leading edges 22 which extend at an angle of approximately 120 degrees with respect to each other. The wing 20 further has ten percent vertical tip stabilizers 24 to maintain dynamic stability and self-alignment in arbitrary current orientations. The stabilizers have two degrees of toe-in to increase stability. The toe-in illustrated by lines A—A in FIG. 2.

The wing 20 is constructed so that it will be buoyant in the water, i.e. it must be moored adjacent the bottom of the waterway to prevent it from floating to the surface. The wing is preferably tethered from a point 26 of connection on the wing which is forward of the mean hydrodynamic center of pressure 28 and forward of the center of buoyancy 30 of the wing. This produces the desired negative angle of attack. The wing will float taut on its mooring adjacent the bottom, i.e. one or two meters above the bottom. The wing will weather vane into the current. Because the wing is moored in an inverted orientation relative to the conventional use of an airfoil shape, water flowing past the wing will cause a downward lift. This downward lift diminishes or reduces the net positive buoyancy of the wing. It is this downward directed lift force which does the work of resuspending the sediments or flocs. The work is done against the buoyancy of the wing so that ultimately the wing buoyancy is the potential energy reservoir for the sediment resuspension. To maximize the amount of resuspension work which the wing can extract from its buoyancy at a given flow speed, the downward lift of the wing must be maximized. The buoyant upward force of the wing is preferably greater than the downward force produced by the lift of the wing.

To optimize vortex airfoil lift force, optimum airfoil shapes can be computer generated utilizing a canonical form of Stratford pressure recovery (Stratford 1959, and Liebeck, 1976). The desired maximum lift coefficient is specified in terms of the maximum pressure coefficient, $\overline{C}_p$ on the suction side of the airfoil, where $$C_p = \frac{P - P_o}{\frac{1}{2} PU_o^2}$$

where $P_o$ and $U_o$ are the static pressure and velocity at the thickest point of the airfoil, $S_o$. The flow is required to originate at a stagnation point $S_p$ at the airfoil nose or apex, and the length of acceleration region, $S_o$ calculated from the momentium thickness relation, $$\sigma_o = 38.2(S_o - S_p)\left[\left(\frac{1 - C_p}{1 - \overline{C}_p}\right)^{\frac{1}{2}} \frac{2U_\infty \sigma_o}{\nu}\right]^{-\frac{3}{8}} \left[\int_{S_p}^{S_o} \left(\frac{U}{U_o}\right)^5 d\left(\frac{S}{S_o - S_p}\right)\right]^{-\frac{3}{8}} \quad \text{Equation I}$$

where $\sigma_o$ is a normalized curvilinear length variable weighted by the free stream velocity according to $$\sigma_o = \int_{S_p}^{S_o} \left(\frac{U}{U_\infty}\right)^3 ds$$

The suction side velocity distribution over the decelerating portion from $S_o$ to the trailing edge of the airfoil is given by the cononical Stratford recovery relations, Equations II $$\begin{cases} \overline{C}_p\left(\frac{\sigma}{\sigma_o}\right) = 0.49\left\{\left(\frac{U_o\sigma_o}{\nu}\right)^{1/5}\left[\left(\frac{\sigma}{\sigma_o}\right)^{1/5} - 1\right]\right\}^{\frac{1}{2}} & \text{if } \overline{C}_p \leqq \frac{4}{7} \\ \overline{C}_p\left(\frac{\sigma}{\sigma_o}\right) = 1 - \frac{U}{\left[\frac{\sigma}{\sigma_o} + b\right]^{\frac{1}{2}}} & \text{if } \overline{C}_p \geqq \frac{4}{7} \end{cases}$$

From the velocity distributions specified by equations I and II above, an airfoil profile contour may be calculated using Bernoulli equations. Not every velocity distribution based on and assumed maximum lift or pressure coefficient, $C_p$, yields a physically meaningful airfoil. When the maximum lift is specified too large, a double entrance or open ended profile often results. By an iteration process, the vortex airfoil profile 32 of FIG. 7 was generated, having a maximum calculated lift coefficient of $$C_L = \frac{F_1}{\frac{1}{2} PU_\infty^2} = 1.58$$

At a Reynolds number $= U_\infty S/\nu = 10^6$

Figure 7:
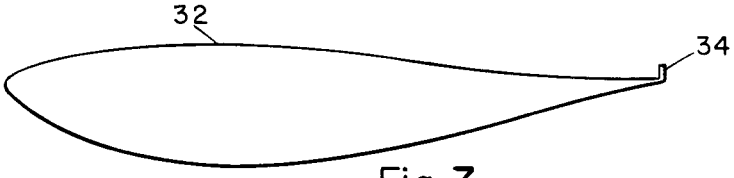
FIG. 7 is a cross-section view of an alternate airfoil shape for the wing.

In order to maximize the net vertical uplift and the vortex produced by the inverted wing, the wing must be moored to the bottom at a negative angle of attack relative to the current. Such a mooring arrangement is illustrated by the orientation of the wing 18 in FIG. 8 relative to the direction of the current indicated by the arrow 19. Laboratory tests indicates that a wing having an airfoil shape 32 (FIG. 7) begins to separate or stall on the suction side at a downward inclination of approximately ten degrees. The airfoil shape of FIG. 7 is most effective in resuspending sediments when the wing having this airfoil shape is partially stalled at angles of approximately twelve degrees to approximately fifteen degrees. The Stratford pressure recovery is invalid once flow separation insues and cannot explain the apparent greater lift in the partially separated conditions. The most likely explanation is that a new vortex system is added with the onset of separation on the suction side. A leading edge vortex sheet having the same circulation as that which the high lift profile generates results from any stalled or partially stalled delta wing or swept wing. Therefore, the leading edge vortex appearing at stall enhances the total circulation about the wing, increasing its lift beyond theoretical maximums.

A further augmentation to the vortex system of the wing of our invention may be produced by a small, upwardly extending flap or vortex step 34 (FIG. 8) connected along the trailing edge of the pressure side of the wing. The height of this flap may be one to two percent of the cord of the wing. This concept was first introduced on race car wings to increase traction, as noted by Liebeck in 1976. The vortex step or so called "Gurney flap" is believed to create a small separation bubble with a standing eddy on the pressure side in the neighborhood of the trailing edge. The induced velocity of this standing vortex turns the suction side flow slightly around the salient trailing edge imparting a slight extra increment of circulation and therefore more lift. Laboratory tests confirmed that adding such a flap to a 10:1 aspect ratio wing causes a significant increase in sediment suspension levels at each angle of attack under or above stall.

We have further discovered that at certain angles of attack, the wing may begin to experience pitch oscillations. These may be eliminated by adding a predetermined amount, for example three degrees, of spanwise twist or "washout" at each tip section of the wing relative to the root.

Figure 3:
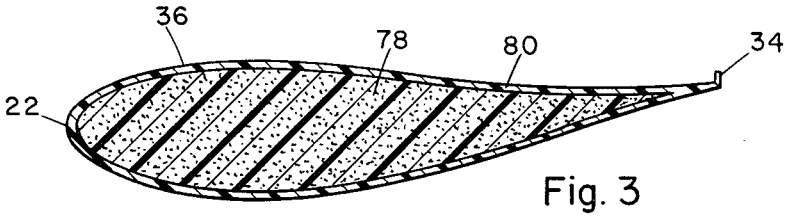
FIG. 3 is an enlarged cross-section view taken along line 3—3 of FIG. 2 illustrating the airfoil shape of the wing.

FIGS. 3 and 8 illustrate alternate airfoil shapes for the wing of the present invention which were generated by computer. The airfoil shape 36 of FIG. 3 maximizes downward lift at an overstall negative angle of attack. The algorithym utilized to generate this airfoil shape on the computer is based upon a canonical form of the turbulent pressure recovery for the separation threshold $au/ay=0$ along the aft portion of the suction side of the airfoil. The Reynolds number for this airfoil shape is $u^*c/\nu=1\times10^6$.

The airfoil shape 38 illustrated in FIG. 8 also maximizes downward lift at an overstall negative angle of attack. The algorithym utilized to generate this airfoil shape on the computer is based upon a canonical form of the turbulent pressure recovery for the separation threshold $au/2y=0$ along the aft portion of the suction side of the airfoil. The Reynolds number for this design is $u^*c/\nu=6.2\times10^6$.

The wing of our invention can be rigidly moored to the bottom of the waterway at a fixed angle of attack or the wing can be tethered to permit variations in the angle of attack. The free or tethered mooring of the wing is preferred because the wing does not collect sediment during slack water conditions as the wing can hang suspended on its edge. Various arrangements of mooring points and center of buoyancy locations relative to the hydrodynamics center of pressure may be analyzed to determine optimal resuspension efficiency. If a freely moored wing is made slightly unstable (divergent by moving the mooring point aft toward the hydrodynamic center of pressure), the ensuing pitch-yaw oscillations maximize the cross-stream section scoured.

Figure 4:
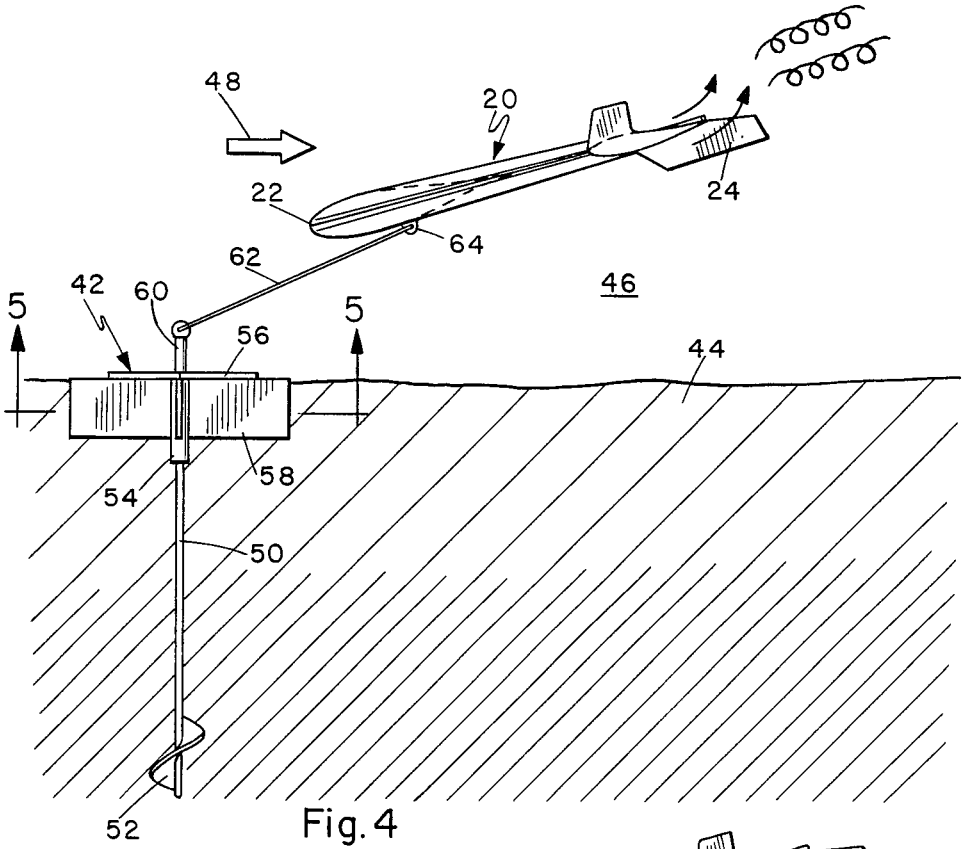
FIG. 4 is a side elevation view illustrating the wing of FIG. 2 tethered to an anchor mechanism imbedded in the bottom of a navigation channel.
Figure 6:
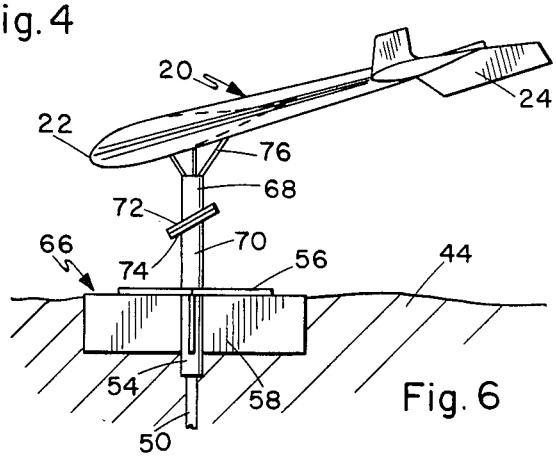
FIG. 6 is a side-elevation view illustrating an alternate anchor mechanism for rigidly mooring the wing of FIG. 2 to the bottom of the navigation channel at a predetermined negative angle of attack.

FIGS. 4 and 6 illustrate tethered and rigid mooring systems, respectively, for a wing, such as 20, constructed in accordance with the present invention. Referring first to FIG. 4, anchor means 42 is provided for anchoring the wing 20 adjacent the bottom 44 of the waterway 46 having a current which flows in the direction of arrow 48. The bottom of the waterway may comprise a thick fluid mud layer having poor strength properties. The distance between the wing 20 and the surface of the bottom 44 must be maintained substantially constant to insure optimal resuspension efficiency. As the upwash and turbulent wake generated by the wing 20 begins to scour the bottom, the separation between the wing and the bottom would tend to increase, thereby making further scouring less and less effective. Therefore, anchor means 42 must lower the wing to maintain a substantially constant distance between the wing and the bottom of the waterway as the bottom is scoured away.

Figure 5:
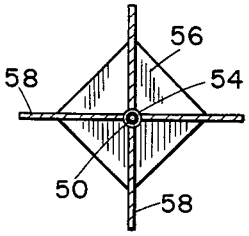
FIG. 5 is a horizontal cross-section view of the anchor mechanism of FIG. 4 taken along line 5—5 of FIG. 4.

Anchor means 42 (FIG. 4) includes a vertical shaft 50 having a screw 52 at its lower end so that the shaft can be screwed into the mud bottom. A cylindrical collar 54 (FIGS. 4 and 5) is vertically slidable on the upper end of the shaft 50. A settling plate 56 connected to the upper end of the collar 54 extends perpendicular to the shaft 50. The settling plate levels itself near the upper horizon of the fluid mud bottom 44. Four blades 58 extend radially outwardly from the collar 54 perpendicular to the plane of the settling plate 56. The blades 58 may be welded along their end and side edges to the collar 54 and the bottom of the settling plate 56, respectively. The blades 58 support the lateral bending of the shaft 50 in the fluid mud which results from hydrodynamic drag on the wing 20. The collar 54, the settling plate 56, and the blades 58 together form a shear collar assembly. The weight of this assembly exceeds the buoyancy of the wing. The horizonal settling plate 56 prevents the shear collar assembly from settling down into the depths of the fluid mud under its own weight.

A mast 60 (FIG. 4) extends vertically from the collar and settling plate. A tether 62 is pivotally connected to one end to the upper end of the mast 60 and is pivotally connected at its other end to a coupling 64 attached to the wing 20 along its center line at a point of connection such as 26 (FIG. 2). This insures that the wing assumes the desired negative angle of attack. Thus, as the scour action generated by the wing 20 removes mud from the bottom of the waterway, the shear assembly slides down the anchor shaft by an equal increment and the wing remains within its optimal separation above the bottom of the waterway. The mast 60 may have a hollow bore therethrough along its entire length so that the upper end of the shaft 50 may project therethrough.

FIG. 6 illustrates an alternate anchor means 66 for rigidly mooring a wing such as 20 adjacent the bottom of the waterway at a fixed negative angle of attack. The anchor means 66 is constructed similar to the anchor means 42 of FIG. 4 in that both include the shaft 50, screw 52, collar 54, settling plate 56 and support blades 58. The anchor means 66 of FIG. 6 thus is also capable of lowering the wing to maintain a substantially constant distance between the wing and the bottom of the waterway as the bottom is scoured away by the trailing wake from the wing.

The anchor means 66 (FIG. 6) further includes upper and lower cylinders 68 and 70 having abutting angled plates 72 and 74 welded to their ends. Struts 76 rigidly connect the wing 20 at its midsection to the upper end of the cylinder 66 at a negative angle of attack. Relative rotation between the plates 72 and 74 may be made to adjust the angle of attack of the wing 20. Thereafter, the plates 72 and 74 are rigidly secured together by suitable means such as bolts (not illustrated). Once the plate 72 and 74 are secured together in the appropriate rotational relationship, the adjustment of the angle of attack of the wing 20 is complete.

The wing may be fabricated of urethane foam injected into a steel reinforced concrete mold. Urethane foam having a high density, such as sixteen pounds per cubic foot, may be poured into a partition section of the mold to create a spanwise extending wing spar in the thickest portion of the airfoil cross-section. The remainder of the wing may be made of urethane foam having a lower density, such as two pounds per cubic foot. The resulting low impact strength results in a wing that presents a minimal hazard to ships and shipyard personnel in the event of accidental collision or mooring failure. Such construction also permits the wings to be removed by the auger bit on a conventional suction dredge should new project depths be required at a subsequent date.

Figure 9:
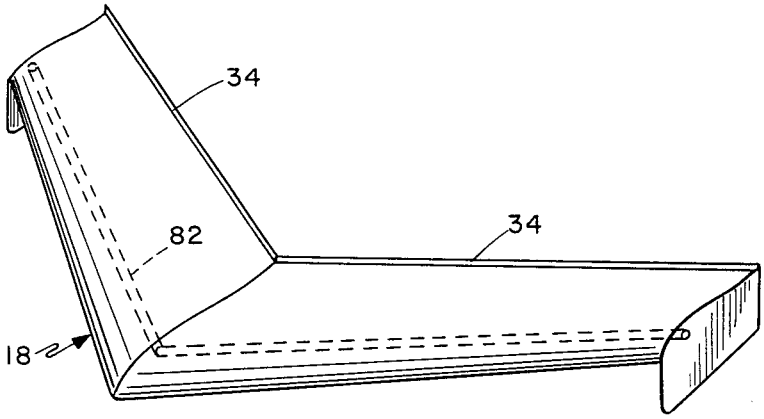
FIG. 9 is a perspective view of another embodiment of the wing having spanwise extending buoyancy adjustment tubes.

If desired, the wing can be manufactured of a urethane foam core 78 (FIG. 3) covered with resin impregnated fiberglass 80. The wings can also be made of a wide variety of other materials such as concrete mixed with an aggragate of sytrene pellets or glass microspheres. Spanwise extending open tubes such as 82 (FIG. 9) may be formed in the wing to achieve optimum buoyancy.

The wing may be coated with a layer of special paint to reduce the build-up of algae and other sea life on the wing surfaces. However, since the wing is anchored adjacent the bottom of the waterway where there is typically little oxygen, biofouling does not present as severe a problem as in the case with vessel hulls, bulkheads and piers.

Figure 10:
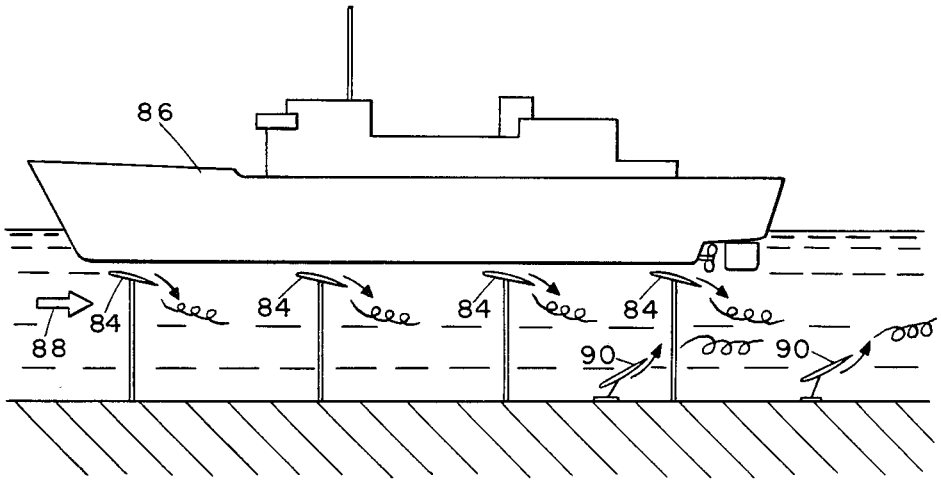
FIG. 10 is a simplified side elevation view illustrating the manner in which a plurality of wings of the type herein described may be rigidly anchored beneath the hull of a ship to prevent mud from clogging the intakes of the ship. In this use, the wings under the hull are inverted relative to the orientation used when the wings are moored adjacent the bottom of the waterway to prevent sediment deposition.

FIG. 10 illustrates an alternate use of the wings of our invention. Specifically, a plurality of our wings 84 may be rigidly mounted beneath the hull of a ship 86 which is to be moored at a fixed location in a waterway for an extended period of time. The wings 84 are oriented to provide an upward lifting force and have a positive angle of attack relative to the direction of the current indicated by the arrow 88. The wings 84 thus produce a net downward deflection of the current beneath the hull of the ship as indicated by the arrows and schematic vortex illustrations aft of the leading edges of the wings 84. This action deflects sediments away from the hull and prevents clogging of the sea water intakes of the ship 86. A plurality of additional wings 90 may be anchored adjacent the bottom of the waterway in the orientation of FIG. 4 to produce an uplift and turbulent wake that will resuspend sediments downwardly directed by the preceding wings 84. This will prevent the build-up of mud underneath the stern and aft of the stern of the ship.

Having described preferred embodiments of our method and apparatus, modifications and adaptations thereof will occur to those skilled in the art. Accordingly, the protection afforded our invention should only be limited in accordance with the scope of the following claims.

We claim:

1. A method of impeding deposition of suspended sediments onto the bottom of a waterway having a current, comprising the steps of:

passively generating a turbulent wake adjacent the bottom of the waterway; and passively generating a net vertical deflection of the current adjacent the turbulent wake wherein the turbulent wake and net vertical deflection of the current are generated by water flowing past a hydrodynamic body anchored adjacent to the bottom of the waterway such that the generating turbulent wake and net vertical deflection of the current will substantially prevent the sediments from depositing on the bottom of the waterway for a predetermined distance downstream of the hydrodynamic body.

2. A method according to claim 1 wherein the hydrodynamic body is a buoyant wing configured and oriented to produce a downward lift as the water flows past the wing.

3. A method according to claim 1 wherein a plurality of hydrodynamic bodies are anchored to the bottom of the waterway in an array.

4. A method according to claim 3 wherein a plurality of arrays of hydrodynamic bodies are anchored to the bottom of the waterway, the arrays being spaced apart in downstream succession a distance sufficient so that a given array will resuspend sediments deflected upwardly by a succeeding array before the sediments settle on the bottom of the waterway.

5. A method according to claim 2 wherein the wing has a swept back configuration.

6. A method according to claim 2 wherein the wing is anchored to the bottom of the waterway to produce a negative angle of attack.

7. A method according to claim 3 wherein the array has a generally V-shaped configuration with its apex pointed upstream.

8. A method according to claim 2 wherein the wing is tethered to an anchor at a point of connection on the wing between a leading edge of the wing and the mean hydrodynamic center of pressure.

9. A method according to claim 2 wherein the wing is tethered to an anchor at a point of connection on the wing between a leading edge of the wing and the center of buoyancy of the wing.

10. An apparatus for impeding the deposition of suspended sediments onto the bottom of a waterway having a current, comprising:

hydrodynamic body means for generating a turbulent wake and a net vertical deflection of the current, the hydrodynamic body means comprising a buoyant wing configured and oriented to produce a downward lift as the water flows past the wing; and means for anchoring the hydrodynamic body means adjacent the bottom of the waterway wherein the net vertical deflection and turbulent wake generated in the water as it flows past the hydrodynamic body means will substantially prevent the sediments from depositing on the bottom of the waterway for a predetermined distance downstream of the hydrodynamic body means.

11. An apparatus according to claim 10 wherein the wing has a swept back configuration.

12. An apparatus according to claim 10 wherein the anchoring means is connected to the wing so that the wing has a negative angle of attack relative to the current.

13. An apparatus according to claim 10 wherein the anchoring means is connected to the wing at a point between the mean hydrodynamic center of pressure of the wing and a leading edge of the wing.

14. An apparatus according to claim 10 wherein the anchoring means is connected to the wing at a point between the center of buoyancy of the wing and a leading edge of the wing.

15. An apparatus according to claim 11 wherein the wing has a vertical stabilizer connected to each tip of the wing.

16. An apparatus according to claim 10 wherein the anchoring means includes means for lowering the wing to maintain a substantially constant distance between the wing and the bottom of the waterway as the bottom is scoured away by the turbulent wake.

17. An apparatus for impeding the deposition of suspended sediments onto the bottom of a waterway having a current, comprising:

hydrodynamic body means for generating a turbulent wake and a net vertical deflection of the current, the hydrodynamic body means comprising a bouyant wing configured and oriented to produce a downward lift as the water flows past the wing; and means for anchoring the hydrodynamic body means adjacent the bottom of the waterway wherein the anchoring means includes:

a shaft having a lower portion vertically insertable in the bottom;

a collar slideable on the shaft;

a settling plate connected to the collar and extending generally perpendicular to the shaft; and means for connecting the wing to the collar.

18. An apparatus according to claim 10 wherein the wing has an upwardly extending flap connected to a trailing edge thereof.

19. An apparatus according to claim 17 wherein the anchoring means includes tether means connected to the wing to permit the wing to pivot into a predetermined angle of attack relative to the current.

20. An apparatus according to claim 11 wherein the wing has a predetermined amount of spanwise twist in the tips thereof.

21. An apparatus according to claim 17 wherein the anchoring means includes means for adjusting the angle of attack of the wing relative to the current.

22. An apparatus according to claim 10 wherein the hydrodynamic body means includes a plurality of buoyant wings each configured and oriented to produce a downward lift as the water flows past the wing, the wings being anchored to the bottom of the waterway in a generally V-shaped array with the apex of the array pointing into the current.

23. An apparatus according to claim 22 wherein there are a plurality of V-shaped arrays, the arrays being spaced apart so that a given array will resuspend sediments deflected upward by a preceding array.

24. An apparatus according to clam 10 wherein the buoyant force of the wing is greater than the downward lift force produced by the water flowing past the wing.

25. An apparatus for impeding the deposition of suspended sediments onto the bottom of a waterway having a current, comprising:

a buoyant wing having a swept back configuration and an inverted airfoil shape for producing a downward lift as the water flows past the wing from a leading edge of the wing to a trailing edge of the wing; and means for anchoring the wing adjacent the bottom of the waterway at a negative angle of attack relative to the direction of flow of the current;

whereby the net vertical deflection and turbulent trailing wake generated in the water as it flows past the wing will substantially prevent the sediments from depositing on the bottom of the waterway for a predetermined distance downstream of the wing.

26. An apparatus according to claim 25 wherein the wing has an aspect ratio from about 8:1 to about 10:1.

27. An apparatus according to claim 25 wherein the wing swept back configuration therefore a pair of leading edges which extend at an angle of approximately 120 degrees with respect to each other.

28. A method of impeding deposition of suspended sediments onto the bottom of a waterway having a current, comprising the steps of:

passively generating a turbulent wake adjacent the bottom of the waterway; and passively generating a net vertical deflection of the current adjacent the turbulent wake wherein the turbulent wake and net vertical deflection of the current are generated by water flowing past a plurality of arrays of hydrodynamic bodies anchored to the bottom of the waterways, the arrays being spaced apart in downstream succession a distance sufficient so that a given array will resuspend sediments deflected upwardly by a succeeding array before the sediments settle on the bottom of the waterway.

29. A method according to claim 28 where in each array has a generally V-shaped configuration with its apex pointed upstream.

30. An apparatus according to claim 25 wherein the anchoring means is connected to the wing at a point between the mean hydrodynamic center of pressure of the wing and a leading edge of the wing.

31. An apparatus according to claim 25 wherein the anchoring means is connected to the wing at a point between the center of buoyancy of the wing and a leading edge of the wing.

32. An apparatus according to claim 25 wherein the wing has a vertical stabilizer connected to each tip of the wing.

33. An apparatus according to claim 25 wherein the anchoring means includes means for lowering the wing to maintain a substantially constant distance between the wing and the bottom of the waterway as the bottom is scoured away from the turbulent trailing wake.

34. Apparatus according to claim 25 wherein the wing has an upwardly extending flap connected to a trailing edge thereof.

35. An apparatus according to claim 25 wherein the wing has a predetermined amount of spanwise twist in the tips thereof.

36. An apparatus according to claim 25 wherein the hydrodynamic body mans includes a plurality of buoyant wings each configured and oriented to produce a downward lift as the water flows past the wing, the wings being anchored to the bottom of the waterway in a generally V-shaped array with the apex of the array pointing into the current.

37. An apparatus according to claim 36 wherein there are a plurality of V-shaped arrays, the arrays being spaced apart so that a given array will resuspend sediments deflected upward by a preceding array.

38. An apparatus according to claim 25 wherein the buoyant force of the wing is greater that the downward lift force produced by the water flowing past the wing.

* * * * *

UNITED STATES PATENT AND TRADEMARK OFFICE

CERTIFICATE OF CORRECTION

PATENT NO. : 4,560,304

DATED : December 24, 1985

INVENTOR(S) : Scott A. Jenkins and Joseph B. Sparks

It is certified that error appears in the above-identified patent and that said Letters Patent are hereby corrected as shown below:

Column 11, line 58, Claim 27 after the word "therefore" insert --defines--.

Signed and Sealed this

*Twelfth* Day of *August 1986*

[SEAL]

*Attest:*

DONALD J. QUIGG

*Attesting Officer*

*Commissioner of Patents and Trademarks*